US008562249B2

(12) United States Patent
Owegeser

(10) Patent No.: US 8,562,249 B2
(45) Date of Patent: Oct. 22, 2013

(54) PAVING MACHINE WITH A STORAGE CONTAINER

(75) Inventor: Johann Owegeser, Illerrieden (DE)

(73) Assignee: SMG Sportplatzmaschinenbau GmbH, Vohringen (DE)

( * ) Notice: Subject to any disclaimer, the term of this patent is extended or adjusted under 35 U.S.C. 154(b) by 0 days.

(21) Appl. No.: 13/228,043

(22) Filed: Sep. 8, 2011

(65) Prior Publication Data

US 2012/0063848 A1 Mar. 15, 2012

(30) Foreign Application Priority Data

Sep. 10, 2010 (DE) ..... 20 2010 012 456 U

(51) Int. Cl.
*E01C 19/20* (2006.01)

(52) U.S. Cl.
USPC ..... 404/108; 404/101; 404/118

(58) Field of Classification Search
USPC ..... 404/101–105, 113–115, 118
See application file for complete search history.

(56) References Cited

U.S. PATENT DOCUMENTS

| | | | | |
|---|---|---|---|---|
| 3,108,517 | A | 10/1963 | Fingland | |
| 3,557,672 | A | 1/1971 | Shurtz et al. | |
| 4,643,475 | A * | 2/1987 | Neumann | 296/10 |
| 5,356,238 | A * | 10/1994 | Musil et al. | 404/84.1 |
| 5,533,828 | A | 7/1996 | Campbell | |
| 6,481,925 | B1 * | 11/2002 | Olson | 404/108 |
| 7,458,748 | B2 * | 12/2008 | Guntert et al. | 404/118 |
| 7,654,772 | B1 * | 2/2010 | Zimmerman | 404/108 |
| 8,025,458 | B2 * | 9/2011 | Musil et al. | 404/86 |
| 8,113,736 | B2 * | 2/2012 | Wilson, Sr. | 404/72 |
| 8,128,314 | B2 * | 3/2012 | Buschmann et al. | 404/118 |
| 8,167,513 | B2 * | 5/2012 | Ryan | 404/75 |
| 8,308,394 | B2 * | 11/2012 | Whitley | 404/75 |
| 2007/0065230 | A1 * | 3/2007 | Musil et al. | 404/108 |
| 2008/0048351 | A1 * | 2/2008 | Zimmerman et al. | 264/31 |

FOREIGN PATENT DOCUMENTS

| | | | |
|---|---|---|---|
| DE | 2833311 | A1 | 2/1979 |
| DE | 9306106.4 | U1 | 10/1993 |
| DE | 19733588 | A1 | 2/1999 |
| DE | 19800915.13 | A1 | 7/1999 |

* cited by examiner

*Primary Examiner* — Raymond W Addie
(74) *Attorney, Agent, or Firm* — Loginov & Associates, PLLC; William A. Loginov

(57) ABSTRACT

The invention relates to a self-propelled paving machine for floor coverings respectively cover layers, particularly for synthetic floor coverings respectively resilient base layers, for synthetic coverings for sports surfaces, such as jogging tracks, small playing fields, runways for long jump installations, playgrounds, screed, particularly synthetic resin screed or the like, wherein the material is distributed uniformly over a fill-in width on a prepared under-floor, and pulled off or flattened there by at least one flattening plank, wherein a storage container is provided which is connected with a fill-up area of the paving machine, and the paving machine presents a carriage, and wherein the fill-up area is provided between a rear closing-off of the carriage, viewed in the travel direction, and the flattening plank, wherein a direct delivery of the material from the storage container into the fill-up area is provided.

26 Claims, 4 Drawing Sheets

PAVING MACHINE WITH A STORAGE CONTAINER

FIELD OF THE INVENTION

The invention relates to a paving machine for floor coverings respectively cover layers, particularly for synthetic floor coverings respectively resilient base layers, for synthetic coverings for sports surfaces, such as jogging tracks, small playing fields, runways for long jump installations, playgrounds, screed or the like.

BACKGROUND OF THE INVENTION

In the state of the art it is known that such paving machines can be used, for example, for producing cover layers with synthetic coverings. For this purpose, the material which forms the cover layer is mixed in a mixer or mixing apparatus, and then distributed by a paving machine. Here, the paving machine is designed in such a manner that it has a distribution shield which distributes the material that lies in the paving direction before the paving machine, approximately at the height of the synthetic layer, before the hardening of the latter respectively solidification. The problem here is that the paving machine as a rule has a carriage, which is driven either by a drive system or which can also possibly be driven by other traction means, wherein the carriage then covers the width which in fact should still form the cover layer. In the process, the material, which has been completely mixed and which also has certain adhesive properties, reaches the area in between the carriage which as a rule is designed as a chain carriage. It then keeps adhering to this carriage. Besides the disadvantageous effect that said region which the carriage covers cannot be filled up properly, so that in principle, before scraping off or flattening, a secondary manual process has to be carried out, and as a result there is also an effect on lane stability. Known paving machines already have a flattening plank which, viewed at the end of the device in the paving direction, provides for the cover layer being flattened and optionally slightly compacted. The floor coverings are then also flattened with a compactor. Said flattening can be done manually. In other cases, it is already accomplished by means of a motor driven compactor.

Paving work is relatively laborious, so that, for example, using known paving machines, a person must always stand on the paving machine to fill up with additional material as needed in front of the flattening plank, so that a sufficient filling level is present there, as required to obtain a clean cover. In the marginal area of surfaces that have already been filled up, respectively in the marginal area of the surface overall, it is often necessary to do rectification work with a screed trowel, which naturally increases the cost considerably. The connection of two paving lanes located next to each other is always problematic here. Moreover, manual distribution, particularly refilling in the heap-up area before the flattening plank, particularly in the marginal areas, is a very expensive and time consuming activity. In addition, this manner of proceeding can also lead to corresponding quality deficits and associated rectification work.

An additional disadvantage of the solutions of the state of the art is that fill-up material indeed reaches the area in between the carriage, for example, a chain carriage, which results in this paving machine no longer being guaranteed to move in a straight direction, respectively to present directional stability. As with tracked vehicles on rails, if one side is blocked or access to it prevented, deviations from the direct respectively straight movement result. This also leads to problems, and continual readjustment by the operator.

Starting from the above described state of the art, the problem of the invention is to optimize the paving with floor coverings, particularly synthetic floor coverings, for sports surfaces, play areas, jogging tracks, but also with screed or the like.

SUMMARY OF THE INVENTION

The problem of the invention is solved by a paving machine for floor coverings, respectively cover layers, particularly for synthetic floor coverings, respectively resilient base layers, for synthetic coverings for sports surfaces, such as jogging tracks, small playing fields, runways for long jump installation, playgrounds, but also for screed, particularly synthetic screed or the like, wherein the material is distributed uniformly over the fill-in width on a prepared under-floor, and pulled off respectively flattened there by means of at least one flattening plank, wherein a storage container is provided which is connected to a fill-up area of the paving machine. By means of this solution, it is now possible to improve the unsatisfactory work processes with regard to the distribution of the material for the floor coverings, because now a storage container is provided which is connected to the fill-up area of the paving machine. Accordingly, the premixed material is filled into the reservoir container, and from there it moves into a fill-up area, in particular at the desired height for the paving machine. As a result, it can then be directly flattened and optionally compacted, without any manual rectification work. The new concept of the paving machine according to the invention also makes it possible that carriage areas in particular, for example, chain cases, are now filled up sufficiently. Moreover, a sufficient height is now successfully guaranteed, almost automatically, for the accumulation of the material over the floor for an angle of repose, and particularly also for the transport of the material outwards into the critical area of the margins of the paving machine. Consequently, an increase in the paving speed is naturally also achieved, and the paving with the floor covering no longer requires as many workers. Accordingly, as a result of the solution according to the invention, a synthetic floor paving machine is now made available, which is suitable particularly for producing resilient base layers for sports surfaces.

Moreover, the invention also comprises a screed paving machine, by means of which screed surfaces, particularly synthetic screed surfaces, can also be applied accordingly. This relates particularly to screed surfaces which contain at least certain resilient components in the mixture, resulting then in the formation of at least partially resilient base layers. Naturally, with the paving machine according to the invention it is also possible to produce resilient cover layers with appropriate rubber granulate compounds. Here, the paving machine according to the invention is very universal, and needs to be adapted only to the particular required fill-up height. This can be done with a possibility for adjusting the overall storage container and/or the device, which will be described below.

Now, the material is poured into a storage container which is then filled up with the given volume mass, so that a certain area can be paved without replenishment. In the state of the art, the situation was such that material had to be replenished continually by means of appropriate dump trucks, and it was in fact distributed with appropriate tools. An appropriately dimensioned storage container is now provided, which makes it possible, for example, to pave a distance two to three or four to five times the length of the paving machine itself in one process respectively one work step without interruption. An additional advantage is provided by the solution according to the invention, in which the storage container including the material is located on the device above the fill-up area. As a result, a certain weight is also added to the device respectively the paving machine, which ensures that the paving machine overall presents an excellent directional stability. Since the carriages can now no longer be soiled by the paving material, the quality in this regard can be increased considerably. The need for reworking is considerably reduced or eliminated entirely. An additional advantage is that the fill-up can be achieved over the entire paving width, that is the width of the flattening plank. As a result, the marginal areas are supplied considerably better with material, resulting here too in a quality improvement and/or facilitation of the activity of the operating personnel. The risk of accidents is reduced, because handling in the paving direction in front of the paving machine is no longer needed.

According to the invention, the fill-up area is located immediately, respectively in the paving direction directly, before the flattening plank. The result is that, in the paving direction, this fill-up area is located behind the carriage, preferably, viewed in the travel direction, between the rear closing-off of the carriage and the flattening plank. Consequently, the fill-up area will be located between the carriage of the paving machine and the flattening plank. As a result of this solution, the previously described effects occur, and the carriage is here no longer dirtied. In addition, no subsequent support device is provided, and instead at least the entire work width is available as paving width.

A further development of the invention, which is considered advantageous, provides for the flattening plank to oscillate in the paving plane. The oscillation is here substantially perpendicular to the travel direction. This oscillation of the flattening plank has the effect of a more uniform and cleaner distribution of the material, and an improved distribution in the fill-up area respectively during paving. The oscillation also provides for a proper connection of the paved lanes, because the impact respectively contact area between the lanes is flattened.

It is considered advantageous if a work width of the oscillating flattening plank corresponds to the paving width of the paving machine. Thus, there is always a uniform formation of the individual lanes. Alternatively or additionally it is possible to provide for the work width to protrude beyond the paving width of the paving machine at least in one direction. For this purpose, one provides particularly for a protrusion in the direction of the already paved lane, in order to flatten the already mentioned connection of the lanes to each other, and the resulting joint edge.

An advantage of the paving machine according to the invention is that it allows the transport of large quantities of material, thus avoiding repeated reloading with material. In this connection, it has been found to advantageous if a total length of the paving machine corresponds to a multiple of the fill-in width. In particular, it is considered advantageous if the total length of the paving machine corresponds to 1.5 times respectively 2 times the fill-in width. As a result it is possible, on the one hand, to increase the fill-in quantity of material, and, on the other hand, sufficient stability is conferred to the entire device, so that work can be carried out without rear support device. Moreover, it is provided that the storage container extends substantially over the entire length of the paving machine. As a result, the position of the center of gravity is particularly advantageous, which also contributes to the ability to omit rear support wheels or other support devices.

According to a further development of the invention, it is also provided that the fill-up area is changeable respectively adjustable in terms of its fill-up height, that is it is designed so the height is adjustable. This has the consequence that the filling height for the paving material can be adjusted in accordance with the given material consistency respectively the material properties. Thus, different fill-up heights can be implemented without problem, which further improves the universality of the paving device respectively of the paving machine.

According to an additional aspect of the invention, the paving machine presents a fill-in area which is connected to the fill-up area, and from which the material is led onto the lower under-floor. This fill-in area is supplied for this purpose logically from the storage container, in particular directly. This fill-in area serves particularly to distribute the material uniformly over the width in the paving machine, so that it can trickle respectively slide into the fill-up area at approximately the same height and consistency. This means that a uniform fill-up height has now been achieved over the entire width of the paving machine. In particular, the fill-up cones, which are always critical in the marginal areas, due to the material trickling forwards or to the side, are now handled better, because a uniform distribution is provided. This is favored further by the above-described oscillation of the flattening plank as well as of the area covered. The fill-in area is here advantageously approximately as wide as the entire paving machine, or broader than said paving machine, and it is designed particularly in such a manner that even in the marginal areas, including those into which the flattening plank extends, can be filled up sufficiently.

Consequently, according to a corresponding further development of the above described solution, the fill-up area is provided between the fill-in area and flattening plank. In the process, the material collects in the fill-up area prior to the flattening and/or compaction.

As already mentioned, it is advantageous that a defined quantity of material can be filled in and/or stored in the storage container. This defined quantity in each case depends on the surface to be paved. Thus, it is possible to provide appropriate quantities there, which lead to the paving machine being capable of producing the entire paving lengths without interruption. In the process, the material can also be determined in accordance with the desired number of meters, that is the length of the surface to be paved, or using the desired pavement thickness.

It is particularly advantageous according to the invention if the storage container is arranged, in the operating position, above the fill-in area. As a result, the sliding or trickling of the filling material into the fill-in area and then from there into the fill-up area can be designed extremely advantageously. Accordingly, the storage container is also connected according to the invention with the fill-in area.

The invention is characterized in that the storage container is designed laterally, respectively viewed in cross section, in the shape of a funnel or V shaped, in such a manner that the funnel narrows in the paving direction respectively towards the fill-in area. This leads to the material moving so to speak in a self-propelled manner from the storage container into the fill-in area and then from there into the fill-up area. Manual poking and distributing is no longer necessary to achieve this.

A paving machine, as described above, is characterized according to a further development in that, on the side of the storage container pointing in the paving direction, a continuous inclined feed surface is provided. This means that the lower side of the storage container is designed as a continuously inclined feed surface, so that the material can slide off there without interruption. This occurs in principle due to the force of gravity, and without any mechanical means.

In order to provide for a correct distribution of the fill-in material over the width of the paving machine, at least one distribution device is provided in the storage container. Here, in the simplest design, the distribution device is constructed from at least one guide plate, which is preferably arranged so that it is inclined respectively falling in the paving direction. The result of this is that the material in particular also reaches the lateral areas, for example, if one provides a tent-like construction made of two guide plates in the middle of the storage container. The material then no longer reaches, as in the state of the art, only the middle of the paving machine from which it then still had to be distributed manually; rather it reaches the desired areas in a relatively uniform manner, due to the distribution device in the form of guide plates. A sufficient quantity of material still trickles through to the middle, so that the guide plates do not result in the middle area being sealed off.

Naturally, it is also possible according to the invention that the distribution device is constructed from at least one distributing worm which is arranged at least in the vicinity of the fill-in area. In the process, it is also possible to provide two distributing worms which have, for example, a countercurrent direction of rotation, so that here as well a very homogeneous and uniform distribution can be guaranteed.

According to the invention, it has been found to be advantageous if the storage container has a coating, particularly a replaceable coating. The lining should be designed here, for example, as a film, particularly a sliding film, which has a low frictional resistance. This further promotes the sliding down of the material, and results in the material no longer adhering to or hanging from the bottom or the margins of the storage container. Examples of suitable coatings here are exchangeable synthetic plates, or an exchangeable respectively replaceable adhesive film or an exchangeable PTFE (Teflon) film. Naturally, the coating can also be in the form of an appropriate paint coat, with application of a paint with low frictional resistance. The coat can also be replaced from time to time. However, it is particularly advantageous to use a film, which is then integrated with appropriate clamping mechanisms, so that here as well an excellent sliding can occur, and the film can be replaced particularly easily. The clamping mechanisms can naturally also be applied in such a manner here that they do not prevent the material flow. The invention is characterized in a variant by the fact that the storage container is heatable respectively has a heating device. This makes it possible that the paving material, which can either be delivered preheated, or preheated in the storage container, can be applied as paving at an appropriate temperature, so that, for example, the flattening device can perform the flattening clearly more rapidly. According to an advantageous further development, the flattening device is designed so it can naturally also be heated. If the material now has been at least preheated in the storage container, then it is now possible to increase the paving rate, or to accelerate respectively improve overall in composite of the material respectively the hardening of the material.

In the simplest variant, the storage container is designed so it is open towards the top. Naturally, a solution can also be implemented in which, at the upper opening of the storage container, a cover flap as cap or a film covering is provided, to close said opening. This is particularly advantageous if one wishes to pave longer distances with the reserve in the storage container, because it prevents, for example, dirt from entering into the storage container, or it allows the maintenance of a certain temperature, more advantageously and for a longer time, than with an open variant. A particular advantage here is that it is also possible to pave when it is raining. Due to water, the hardening of the paving material is promoted, because the synthetic material has components that react with water. A cover or a waterproof covering prevents this.

The paving machine according to the invention is also characterized in that, on the side of the storage container which faces the flattening plank, an operating respectively feed flap is provided, by means of which the material flow of the material to be applied can be controlled. This operating respectively feed flap can here be changed in terms of its position with respect to the fill-in area, so that the material flow can be controlled as a result. Consequently, a further development of this variant possesses at least one adjustment device for the operating respectively feed flap. It is also advantageous if locking and/or fixation device is provided to fix a separation, once it has been selected, of the operating or feed flap.

It is particularly advantageous here if the operating and feed flap is formed from several parts which can be adjusted separately from each other. In the process, the lateral areas of the storage container are adjustable in particular, so that it is possible to adjust there, for example, a broader slit width than in the middle. As a result, the fill-up area is successfully designed in the marginal area in such a manner that it is possible to fill up these areas with material in a reliable manner by means of the filling cone produced, and in particular to produce a smooth and uniform final edge. The flaps also serve particularly for the adjustment of the paving width of the paving machine. The setting respectively adjustment capacity of the operating respectively feed flap is here provided with several technical possibilities. Thus, it is possible, in the simplest variant, to provide a possibility for mechanical adjustment, for example, by means of a toothed bar driven by a pin. Moreover, it is naturally also possible to provide an electromechanical adjustment. However, in the most advantageous variant, a hydraulic adjustment possibility is provided, since the paving machine generally already has a hydraulic installation. As a result, it is relatively simple to make available the corresponding media, in order to also adjust the operating and feed flap.

Accordingly, this occurs advantageously, for example, by means of one or more hydraulic cylinders.

It is also advantageous if the storage container can be taken off respectively exchanged or replaced.

The paving machine according to the invention is characterized in that a drive device for the carriage is provided to move the paving machine at least in the paving direction. Several variants are possible here. Thus, for example, it is provided that appropriate hydraulic drive systems are provided here. Naturally, a corresponding drive system by means of at least one electric motor is also possible, if, for example, appropriate connections are present on the object respectively in the object. It is advantageous if one motor is provided for each paving machine chain of the chain carriage. The design with a normal combustion engine is naturally a variant that is also covered by the invention.

The drive system can also be implemented according to the invention by a pulling or pushing device. Said device here is not a direct component of the device. Here, a pulling vehicle is considered to be equivalent to the drive system by means of a cable winch.

Since the storage container has an appropriate dimension, that is an appropriate width and also an appropriate extent in depth, it is advantageous if the fill-in area is provided with at least one stiffening. This stiffening can occur, for example, by means of an angle bracket or a pipe which is then attached to the side walls of the storage container. The stiffening can also be carried out by means of one or more tensioned steel cables, such as, for example, tow ropes.

As already mentioned, the flattening plank can also be designed so its height is adjustable and/or so it can be heated. Accordingly, one can also implement different floor covering heights, by way of the design of the flattening plank, in connection with a different design of the fill-up height. It is also advantageous according to the invention if a transport unit is provided beneath the above described feed surface, which further promotes the downward transport of the material to be installed in the paving area. This transport unit can also be indicated as an adjustment movement of the feed plane, which means that the storage container is put in another angular position, accelerating or decreasing the material flow depending on the angle.

It should be mentioned that the paving machine according to the invention naturally also has an appropriate transport device in order to transport the device to the paving site or away from the paving site. Said device consists, for example, of wheels with adjustable height, which, when positioned, lift the paving machine from the surface, so that the carriage is no longer in contact with the floor. By means of the, for example, four wheels respectively rollers, the transport away respectively the positioning at a new paving site is considerably favored.

BRIEF DESCRIPTION OF THE DRAWINGS

The invention is represented diagrammatically, in particular in an embodiment example, in the drawing. The figures show.

DETAILED DESCRIPTION

In the figures, identical or corresponding elements are in each case provided with the same references, and, unless necessary, they are not described again.

Figure 1:
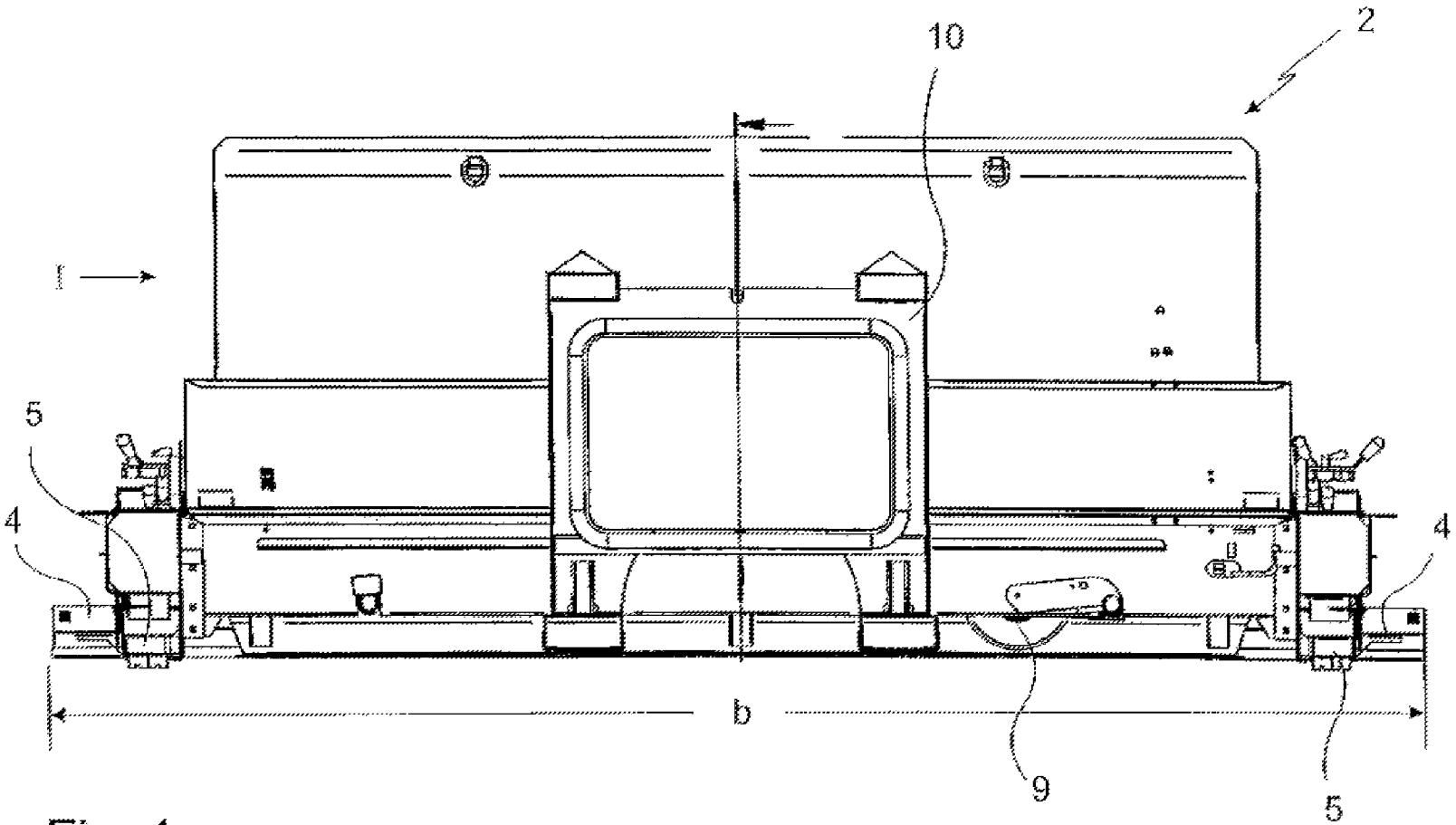
FIGS. 1-4: various views of the paving machine according to the invention.
Figure 2:
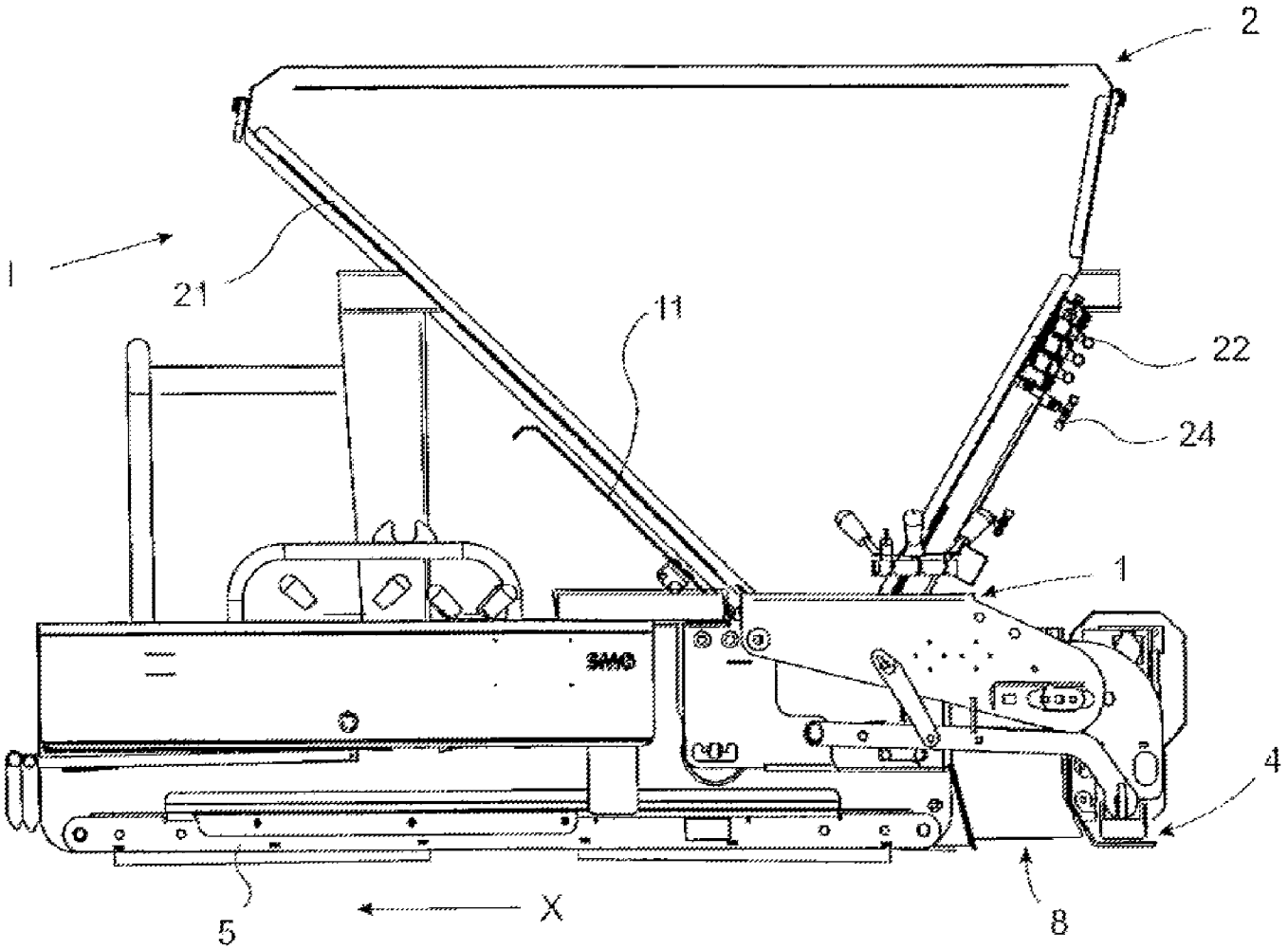
Figure 3:
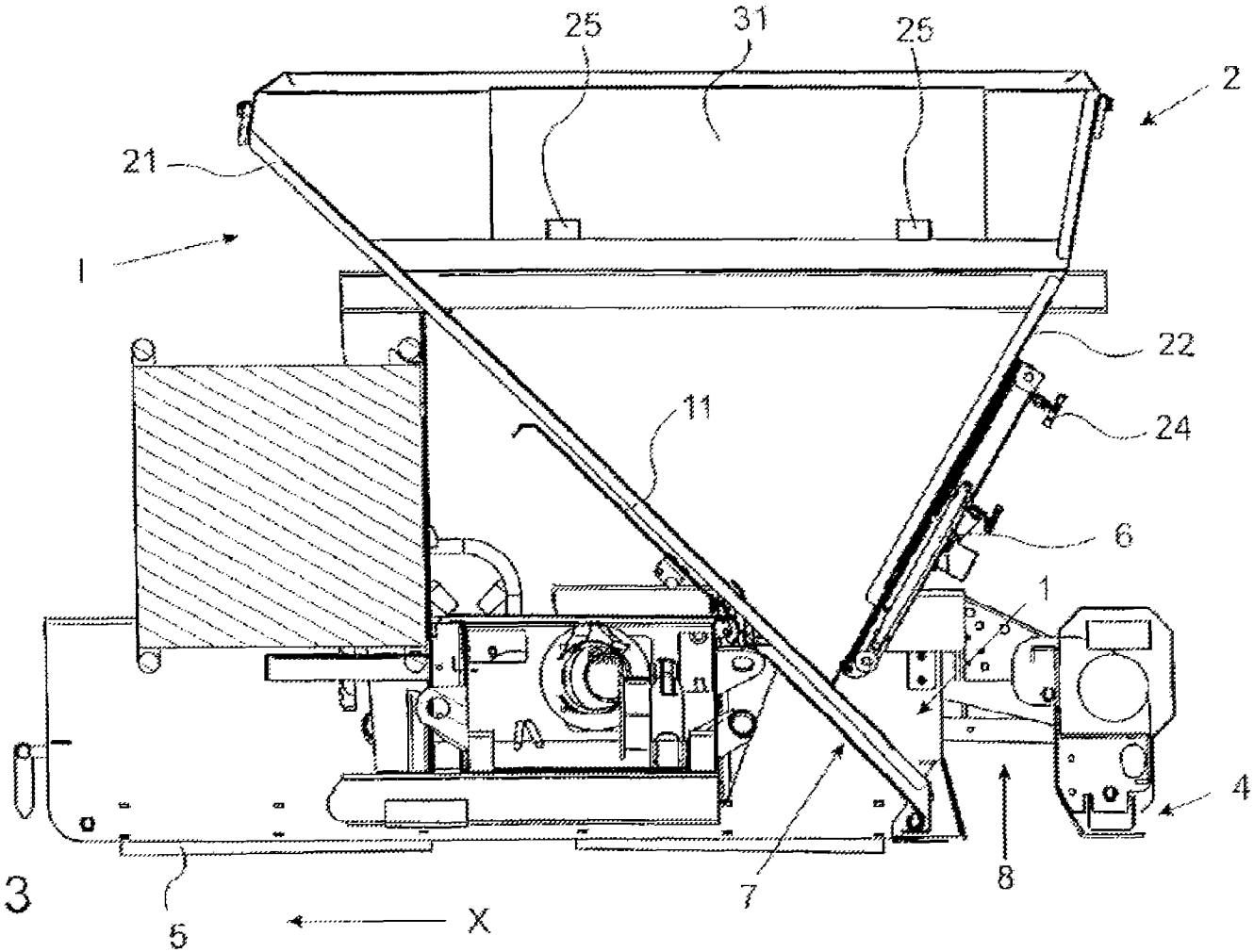

FIGS. 1-4 shows different views of the paving machine I according to the invention. Here, in FIG. 1, a front view is shown, in FIG. 2 a side view, while FIG. 3 shows a cross-sectional representation of the side view, and FIG. 4 a three-dimensional representation of the paving machine according to the invention. The paving machine overall is marked with the reference I. As can be seen, the storage container 2 is arranged on the paving machine I. Said container is provided diagrammatically with an arrow and the reference 2. The carriage 5 is located in front of the flattening plank 4, in the travel direction X. Said carriage is designed, for example, as a chain carriage, and it is consequently accommodated in a type of chain case. It is also clearly apparent that, for transporting the device into and out of the fill-in area, a wheel 9 (of several wheels) is provided, which is here in the raised position, so that the paving machine I can be moved over the carriage 5. The flattening plank 4, as can be seen, is pulled out over the fill-in width b of the entire device, and in particular it is broader than the carriage 5. As a result, the marginal areas are sufficiently compacted and flattened. Reference 10 marks a connection possibility for a drive unit, for example, an electric motor or a generator.

FIG. 2 shows the device according to the invention in a side view. The already presented references are here repeated in general only if it necessary for the understanding. The storage container 2 has an inclined feed surface 21. The latter surface is located before the fill-up area 8, viewed in the paving direction X (see arrow). This fill-up area 8 in turn is arranged between the carriage 5 respectively the rear closing-off thereof, viewed in the travel direction X, and the flattening plank 4. Here, it is provided for the material to be delivered directly out of the storage container 2 into the fill-up area 8. The fill-in area 1 is also indicated diagrammatically only with an arrow and the reference 1. The precise positioning is better visible in FIG. 3, wherein it is clear that this fill-in area 1 is in connection with the fill-up area 8, and that it is located particularly above the fill-up area and, in the conveyance respectively paving direction X, before the fill-up area 8. Moreover, the storage container 2 is designed with a distribution device 3. The latter is described here in the form of the inclined guide plate 31. The distribution device 3 with the guide plates 31 and 32 can be seen even better in FIG. 4. There, the two guide plates 31, 32 are in a roof-shape or tent-shape arrangement, so that material filled in from above fills particularly the lateral areas. As a result, the lateral areas in particular are successfully supplied with material. A sufficiently large quantity of material still reaches the inner area, so that a uniform surface can be formed. An additional possibility of influencing the height of the filling cone respectively the filling material in the fill-up area 8 is provided by the fact that the storage container 2 presents a feed flap 22. This feed flap 22 is here adjustable in terms of height, so that the material flow of the material to be applied can be controlled. For this purpose, an adjustment device 6 is located, for example, on the operating respectively feed flap 22. As in this case, this can be a hydraulic cylinder. Naturally, it is also advantageous to provide a locking or fixation device 24. Once a height has been selected, it can then be fixed appropriately by said device.

It is also advantageous if the operating and feed flap 22 is formed from several parts. Here, it is then possible, for example, to raise the parts of the operating and feed flap 22 which are provided laterally higher than the parts provided in the middle, so that here as well a proper filling width can be achieved on the outside, in order to design the pouring cone in the outer area in such a manner that a correct closing-off forms there with sufficiently dense material. The storage container 2, in the variant represented, presents two stiffenings 25. They are provided here in the form of box material or pipe. Beneath the feed surface 21, a transport unit is marked with the reference 7. This can also be used optionally to adjust the funnel in different angular positions or, on the other hand, to influence the trickling respectively filling rate of the material. Both variants are also covered by the invention here. A maintenance catwalk 11, particularly one that is pivotable respectively swivelable, can be pivoted from a position allowing access to a transport position.

Figure 4:
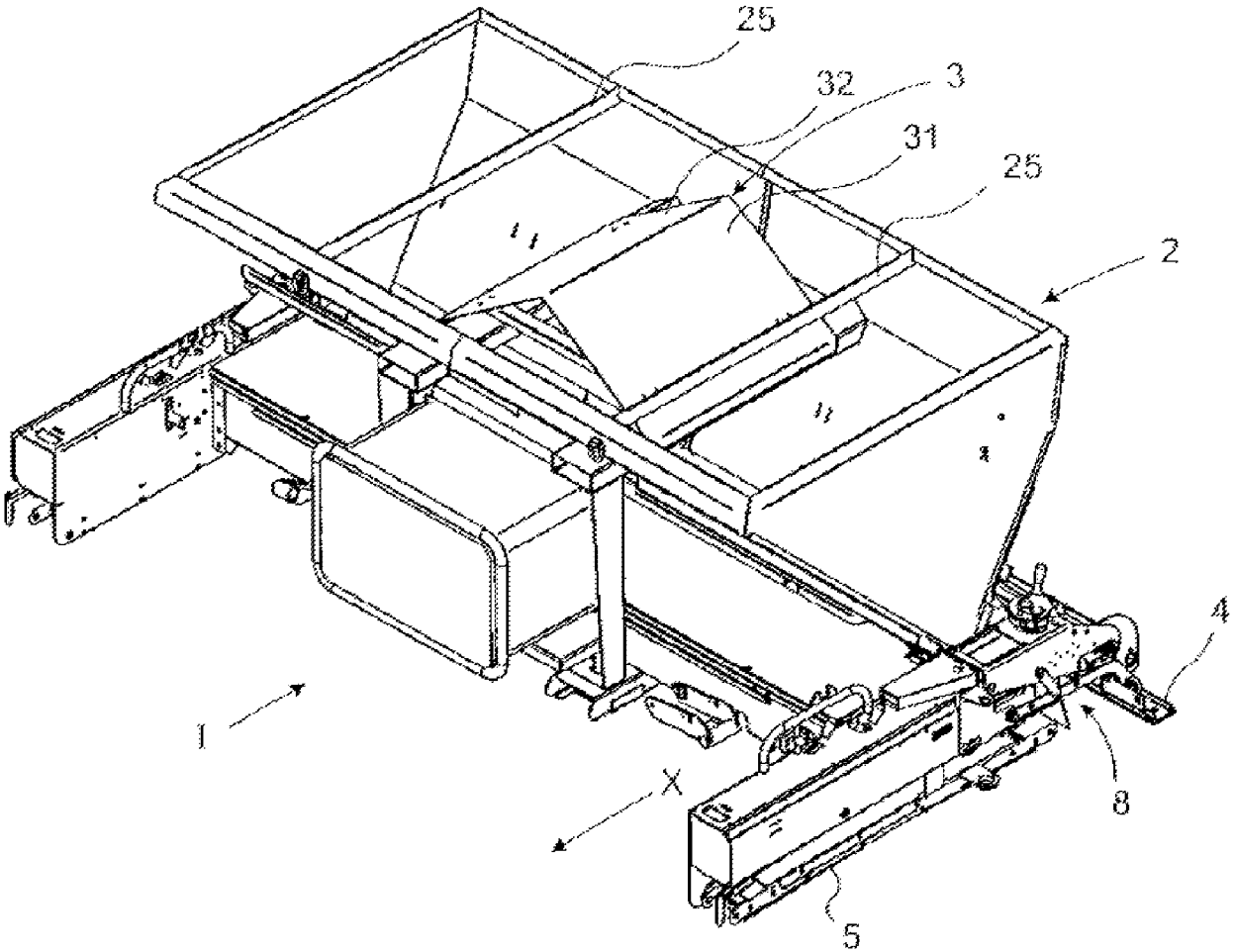

FIG. 3 shows, as already mentioned, the cross-sectional representation of the representation according to FIG. 2 approximately in the middle of the device. FIG. 4 then shows a three-dimensional representation which showing particularly the dimension of the storage container 2. The advantages here are obvious, because said container is arranged precisely above the fill-up area 8, and in such a manner that, through the fill-in area 1, the material also reaches particularly the side areas.

Although the invention has been described using precise embodiment examples, which are presented in the most extensive detail, it should be noted that this serves only for explanation, and that the invention is not necessarily limited to them, because alternate embodiment examples and procedures become clear to persons skilled in the art with a view the publication. Accordingly, changes that can be made without deviating from the content of the described invention are taken into consideration.

What is claimed is:

1. Self-propelled paving machine for use with floor coverings consisting generally of at least one of cover layers, including synthetic floor coverings, resilient base layers for synthetic coverings for sports surfaces, including jogging tracks, small playing fields, runways for long jump installations, playgrounds and screed wherein material thereof is distributed uniformly over a fill-in width on a prepared under-floor, and pulled off or flattened there by at least one flattening plank, the paving machine further comprising:

a fill-up area of the paving machine, a storage container which is connected with the fill-up area of the paving machine, and a carriage for moving the paving machine in a paving direction and including front and rear ends thereof, wherein the fill-up area is provided between a rear end of the carriage, viewed in the paving direction, and the flattening plank, wherein the fill-up area is located immediately, in the paving direction, directly before the flattening plank, and wherein a direct delivery of the material from the storage container to the fill-up area is provided.

2. Self-propelled paving machine according to claim 1, further defining a paving plane, wherein an oscillation of the flattening plank in the paving plane, is substantially perpendicular to the paving direction.

3. Self-propelled paving machine according to claim 1, further defining a paving plane and further comprising a flattening plank oscillating in the paving plane, wherein a work width of the oscillating flattening plank at least one of (a) corresponds to the paving width of the paving machine and (b) protrudes above the paving width at least in one direction.

4. Self-propelled paving machine according to claim 1, wherein the paving machine defines a total length, and wherein the total length of the paving machine corresponds to a multiple of the fill-in width, the multiple comprising one of 1.5 times and 2 times, and the storage container extends substantially over an entire length of the paving machine.

5. Paving machine according to claim 1, wherein a gap is defined between the rear end of the carriage and the flattening plank, and only the fill-up area is disposed therebetween.

6. Paving machine according to claim 1, further wherein the fill-up area defines a fill-up height, wherein the fill-up area is designed so the fill-up height can be respectively adjusted.

7. Paving machine according to claim 1, further comprising a fill-in area, wherein the material is led from the fill-in area onto the under-floor.

8. Paving machine according to claim 1, further comprising a fill-in area, wherein the fill-up area is provided between the fill-in area and the flattening plank, and the material collects in the fill-up area before the flattening and/or compaction.

9. Paving machine according to claim 1, wherein a defined quantity of the material can be at least one of (a) filled in the storage container and (b) stored therein.

10. Paving machine according to claim 1, further comprising a fill-in area and wherein the storage container is arranged so that, in a usage position, it is located above the fill-in area.

11. Paving machine according to claim 1, further comprising a fill-in area, wherein the storage container is connected with the fill-in area.

12. Paving machine according to claim 1, further comprising a fill-in area, wherein the storage container is constructed and arranged in the shape of one of a funnel and a V-shape viewed in lateral cross section, in such a manner that the funnel narrows in the paving direction respectively towards the fill-in area.

13. Paving machine according to claim 1, further comprising a feed surface, wherein, on the side of the storage container directed in the paving direction, a continuously inclined feed surface is provided.

14. Paving machine according to claim 1, wherein, in the storage container, at least one distribution device is provided for the uniform distribution of the material to be applied.

15. Paving machine according to claim 1, wherein, in the storage container, at least one distribution device for the uniform distribution of the material to be applied is provided, and wherein the distribution device is formed from at least one guide plate.

16. Paving machine according to claim 15, wherein the at least one guide plate is one of (a) inclined and (b) dipping in the paving direction.

17. Paving machine according to claim 1, wherein, in the storage container, at least one distribution device for the uniform distribution of the material to be applied is provided, and wherein the distribution device is formed from at least one distributing worm.

18. Paving machine according to claim 1, wherein the storage container includes in the interior a coating, that comprises at least one of (a) a replaceable coating, (b) a film, including a sliding film with low frictional resistance (c) exchangeable synthetic plates, (d) a replaceable adhesive film, and (e) a PTFE film.

19. Paving machine according to claim 1, wherein the storage container is at least one of (a) heatable and includes a heating device, (b) open towards the top, and (c) includes an upper opening with a covering.

20. Paving machine according to claim 19, wherein the covering includes at least one of a cover flap, a cap, and a waterproof film, to close the upper opening.

21. Paving machine according to claim 1, further defining an operating or feed flap provided on the side of the storage container which faces the flattening plank, wherein, by means of the feed flap, at least one of (a) material flow of the material to be applied is controlled, and (b) the paving width of the paving machine is controlled.

22. Paving machine according to claim 1, further comprising a fill-in area, and an operating or feed flap provided on the side of the storage container which faces the flattening plank, wherein at least one of (a) the operating feed flap has at least one of (a) and adjustment device (b) a locking device, (c) a fixation device.

23. Paving machine according to claim 1, further comprising a fill-in area, and an operating or feed flap provided on the side of the storage container which faces the flattening plank, wherein the operating or feed flap is at least one of (a) formed from a plurality of parts, which are adjustable separately from each other, (b) provided so that the storage container can be taken off respectively replaced.

24. Paving machine according to claim 1, further comprising a drive device for the carriage to move the paving machine at least in the paving direction, and wherein at least one stiffening is provided at least in the fill-in area of the storage container.

25. Paving machine according to claim 1, further comprising a transport unit, and including a continuously inclined feed surface provided on the side of the storage container pointing in the paving direction, wherein the flattening plank is constructed and arranged so at least one of (a) a height of the flattening plank can be adjusted, (b) the flattening plank can be heated, and (c) the transport unit is provided beneath the feed surface.

26. Paving machine according to claim 1, further comprising a maintenance catwalk mounted on the paving machine, the maintenance catwalk being constructed and arranged to be pivoted between at least a transport position and a maintenance position.

* * * * *